US006546750B1

(12) United States Patent
Bolster et al.

(10) Patent No.: US 6,546,750 B1
(45) Date of Patent: Apr. 15, 2003

(54) NECKLACE ASSEMBLY AND DISPLAY STRUCTURE

(76) Inventors: Peter J. Bolster, 278 John~M, Clawson, MI (US) 48017; Amy B. Bolster, 278 John~M, Clawson, MI (US) 48017

( * ) Notice: Subject to any disclaimer, the term of this patent is extended or adjusted under 35 U.S.C. 154(b) by 120 days.

(21) Appl. No.: 09/657,649

(22) Filed: Sep. 7, 2000

(51) Int. Cl.[7] ..... A44C 5/00

(52) U.S. Cl. ..... 63/3; 63/1.11; 63/1.16; 63/3.2; 63/33

(58) Field of Search ..... 63/1.11, 1.16, 63/1.17, 3, 3.2, 33; 206/6.1, 19, 495, 566; 211/85.2; 434/245, 246, 386, 395, 400; 428/3; 273/153 R, 159; 446/227, 490

(56) References Cited

U.S. PATENT DOCUMENTS

| | | | | | |
|---|---|---|---|---|---|
| 738,601 | A | * | 9/1903 | Blenke | 52/28 |
| 904,566 | A | * | 11/1908 | Schwab | 132/145 |
| 982,111 | A | * | 1/1911 | Allen | 24/18 |
| D61,912 | S | * | 2/1923 | Hayes | D99/26 |
| 1,639,672 | A | * | 8/1927 | Schraysshuen | 206/348 |
| 2,598,070 | A | | 5/1952 | Randall | |
| 2,651,870 | A | | 9/1953 | Lipic et al. | |
| 2,788,890 | A | | 4/1957 | Mulhern | |
| 2,813,622 | A | * | 11/1957 | Lancellotti | 206/6.1 |
| 2,827,161 | A | | 3/1958 | Rosa | |
| 3,347,037 | A | | 10/1967 | Klang | |
| 3,718,260 | A | * | 2/1973 | Sharp | 211/85.2 |
| D233,362 | S | * | 10/1974 | Scott | D99/27 |
| 3,992,812 | A | * | 11/1976 | Horowitz | 47/45 |
| 4,120,394 | A | | 10/1978 | Soltes | |
| D259,773 | S | * | 7/1981 | Sweet | D11/141 |
| 4,365,246 | A | * | 12/1982 | Dewolf et al. | 345/39 |
| 4,413,736 | A | * | 11/1983 | Nibling | 206/566 |
| D338,315 | S | * | 8/1993 | Larson | D99/27 |
| 5,425,444 | A | | 6/1995 | Chapman | |
| 5,540,324 | A | | 7/1996 | Knapp | |
| 5,551,772 | A | * | 9/1996 | Keffer | 312/114 |
| 5,931,319 | A | * | 8/1999 | Murphy | 211/85.2 |
| 5,950,815 | A | * | 9/1999 | Yetman-Bellows | 206/6.1 |

* cited by examiner

*Primary Examiner*—J. J. Swann
*Assistant Examiner*—Andrea Chop
(74) *Attorney, Agent, or Firm*—Reising, Ethington, Barnes, Kisselle, Learman & McCulloch, P.C.

(57) ABSTRACT

A necklace assembly is constructed to be either worn as a necklace or releasably attached to a display stand. The necklace assembly is comprised of a pendant having at least one passage and at three openings with each opening communicated with at least one other opening through at least one passage with a continuous cord slidably received therein to form at least three adjustable loops external to the pendant. The loops of cord are accessible at the openings in the pendant and can be either adjusted to be worn as a necklace or to be releasably attached to a display stand.

19 Claims, 9 Drawing Sheets

NECKLACE ASSEMBLY AND DISPLAY STRUCTURE

FIELD OF THE INVENTION

The present invention relates to necklace assemblies of the type having a flexible necklace cord and a decorative pendant supported on the cord for wearing about the neck of a user and more particularly to the construction of such assemblies and to a method of displaying the necklace when not being worn.

BACKGROUND OF THE INVENTION

Necklace assemblies include an endless, flexible necklace cord of any of any of a number of materials (e.g., chain, cloth, leather, etc.) and often further include a pendant supported by the cord which is threaded through a single eyelet on the pendant. Necklaces of this general type are commonly stored in a jewelry box, when not worn, or hung by the cord on a stand from a single peg or hook. Necklaces with a single loop of cord are thus limited as to how they can be displayed when not worn.

It is an object of the present invention to provide a necklace assembly better suited for attractive display than that of conventional necklace assemblies.

SUMMARY OF THE INVENTION

A necklace assembly is constructed to be either worn as a necklace or releasably attached to a display stand. The necklace assembly includes a flexible necklace cord and a pendant having at least three cord-engaging support portions slideably engaging the cord to define at least three adjustable loop portions of the cord accessible externally of the pendant. In a first condition, one of the loops is fully extended to maximize its length while minimizing the length of the other loops to enable the extended loop to be worn about the neck of a user.

In a second condition, the loops of the cord are extended approximately to equal lengths. The extended loops are then disposed in engagement with mounting supports of a display frame such that the pendant body is suspended in the frame by the cord with portions of the cord passing between the pendant body and the frame to create a decorative display when the necklace is not being worn by the user.

When the necklace assembly is removed from the display stand and used as a necklace, the display stand is left vacant. The absence of the decorative display may serve to remind the person in possession of the frame of a friend or loved one wearing the necklace. Also, the person away from home wearing the necklace assembly may be reminded of a person remaining at home.

When the necklace assembly is disposed on the display stand, the decorative display operates to indicate the existence of another condition, such as indicating that two persons are home together.

Accordingly, one advantage of the present invention is to provide a necklace assembly having adjustable loops permitting the necklace to be decoratively displayed on a display stand.

Another advantage of the present invention is to provide a necklace assembly that can be removed from being decoratively displayed in the display stand to be worn as a necklace with one of the adjustable loops disposed around the neck of a user.

Yet another advantage of the present invention is to provide a method of indicating the existence of one or more conditions by selectively hanging the necklace on a display stand.

BRIEF DESCRIPTION OF THE DRAWINGS

These and other objects, features and advantages of this invention will be apparent from the following detailed description of the preferred embodiment(s) and best mode, appended claims, and accompanying drawings in which:

FIG. 1-A is an exploded view of the necklace assembly as shown in FIG. 1;

DETAILED DESCRIPTION OF THE PREFERRED EMBODIMENTS

Figure 1:
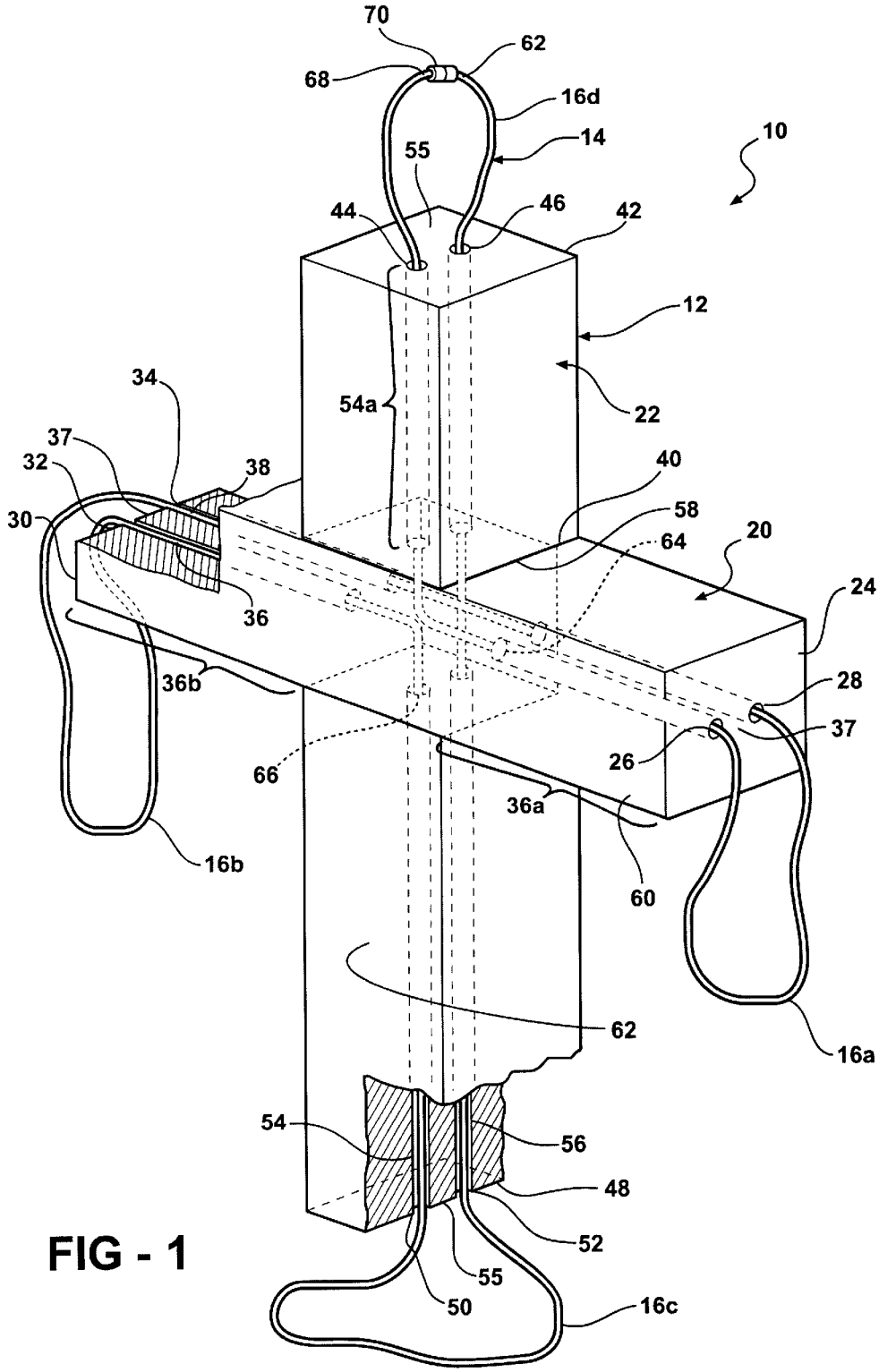
FIG. 1 is a perspective front view of the necklace assembly showing a pendant with a continuous cord slidably received therein.
Figure 1A:
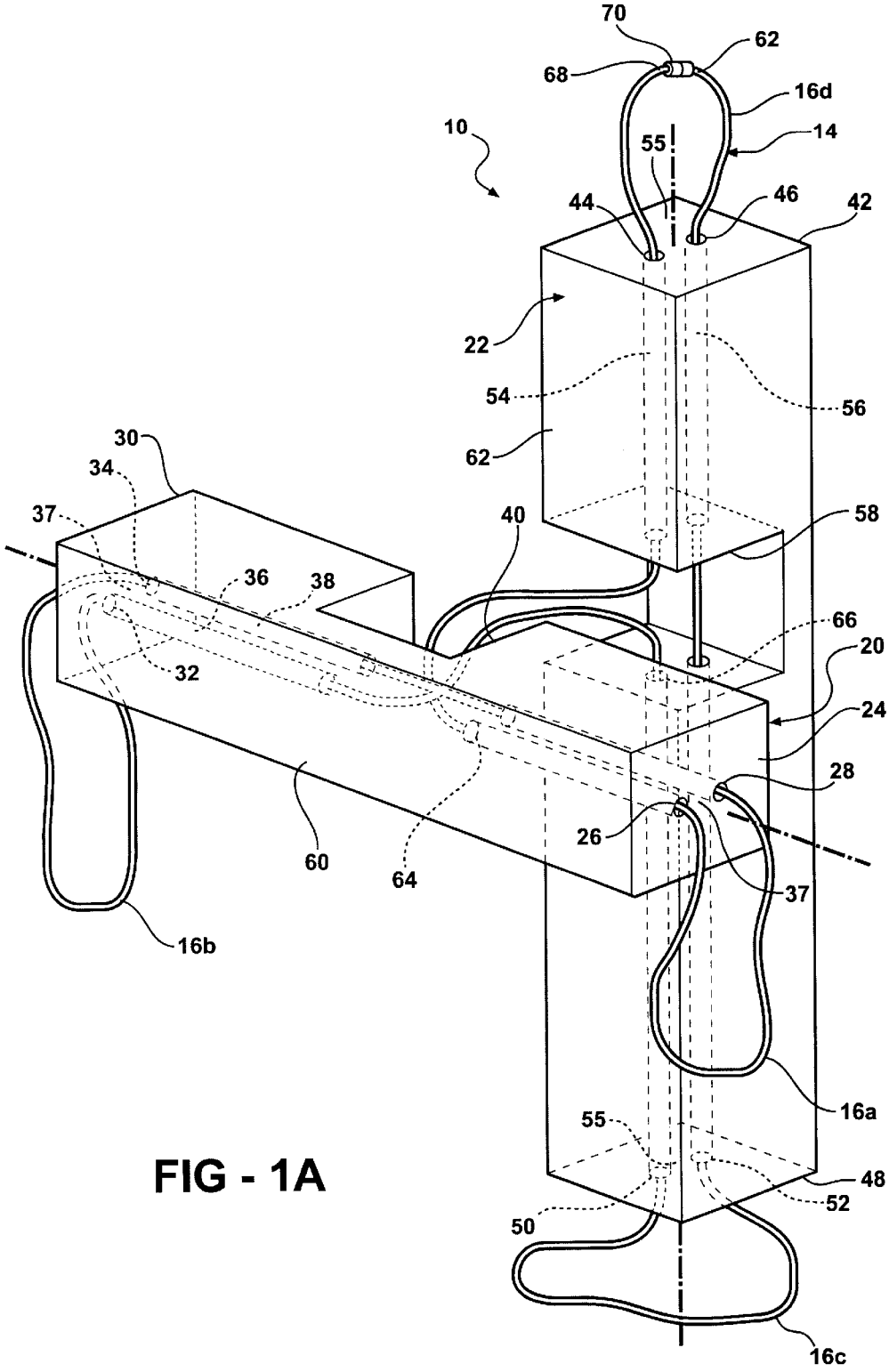
Figure 2:
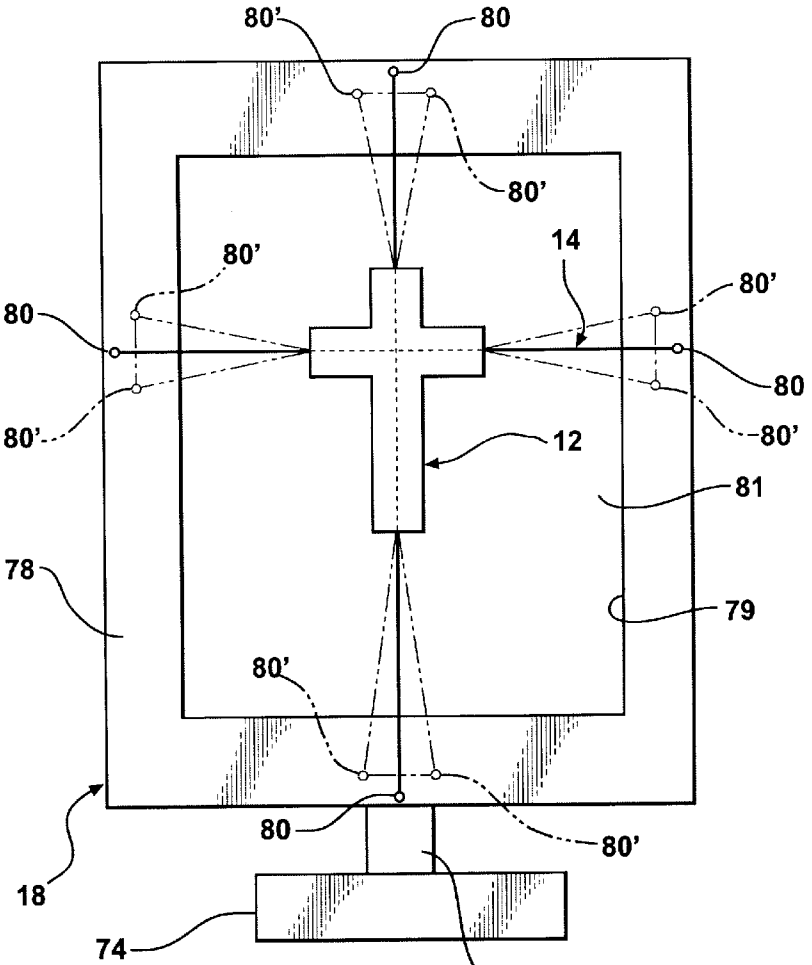
FIG. 2 is a front view showing the necklace assembly releasably attached to a display stand.
Figure 4:
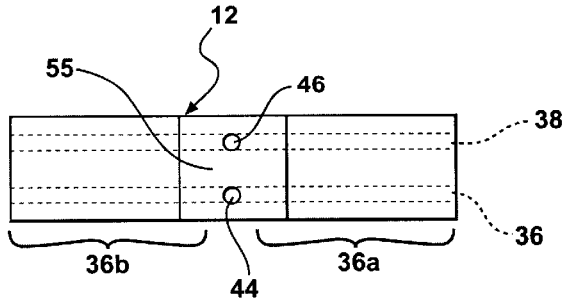
FIG. 4 is a top view of the pendant.
Figure 5:
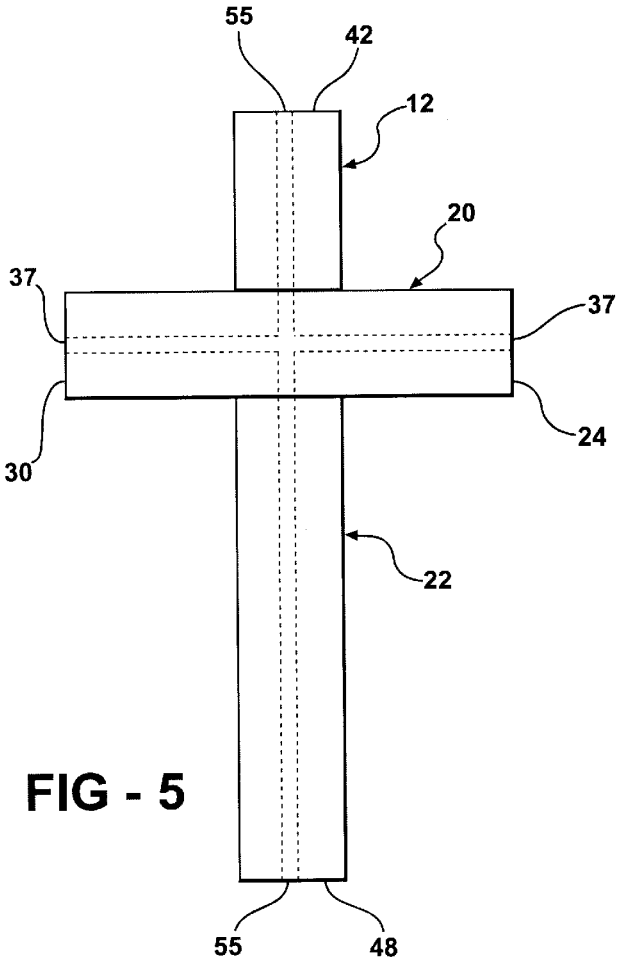
FIG. 5 is a front view of the pendant.
Figure 6:
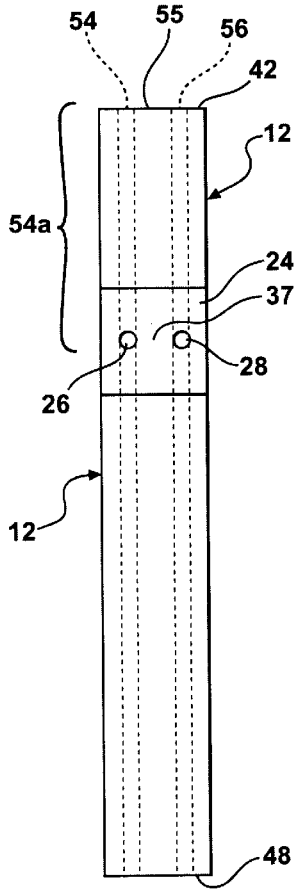
FIG. 6 is a side view of the pendant.

Referring in more detail to the drawings, FIGS. 1–6 illustrate a necklace assembly 10 comprised for a pendant body 12 having a continuous or endless necklace cord 14 slidably routed through at least one passage in the body to form loop portions or loops 16*a–d* of the cord 14 adjustable in size and accessible form the pendant body 12 so that when one of the loops 16*a–d* is maximized in size to be worn as a necklace, the others are minimized in size. The term "cord" is meant to include a strand of flexible material of any type commonly use din necklace applications, and includes such materials as chain links, woven cloth, leather, plastics, woven metal strands, and the like. By "endless", it is meant that the cord is either without ends or has ends joinable by a clasp, know or other such connection so as to assume an endless configuration when worn about the neck of the user. The loops 16*a–d* that are minimized in size are maintained by the pendant body 12 so that they are accessible from the pendant body 12 and may be manually adjusted to the sized necessary to releasably attach the necklace assembly 10 to a display stand 18, as best shown in FIG. 2.

As shown in FIG. 1, the pendant body 12, according to a presently preferred embodiment of the invention, has a horizontal or transverse arm 20 and a vertical or upright arm 22 substantially perpendicular to the horizontal arm 20 and attached thereto to form a cross-shaped pendant body 12. The horizontal arm 20 has a first end 24 having a pair of external openings 26, 28 and a second end 30 having a pair of external openings 32, 34. The external opening 26 of the first end 24 is connected to the external opening 32 of the second end 30 by a passage 36. Likewise, the external opening 28 of the first end 24 is connected to the external opening 34 of the second end 30 by a passage 38. The passages 36 and 38 are preferably generally parallel and separate from each other by intervening partition wall 37 defining cord-engaging portions or stops of the pendant 12 at the ends 20, 30. As best shown in FIG. 1-A, where the pendant body 12 has two separate horizontal and vertical arms 20, 22, respectively, a recess 40 is provided between the first and second ends 24, 30 of the horizontal arm 20, and to facilitate threading the cord 14 throughout the pendant body 12, the recess 40 preferably extends inwardly through both passages 36, 38 in the horizontal arm 20.

The vertical arm 22 has a first end 42 with a pair of external openings 44, 46 and a second end 48 with a pair of external openings 50, 52. The external opening 44 of the first end 42 is connected to the external opening 50 of the second end 48 by a passage 54. Likewise, the external opening 46 of the first end 42 is connected to the external opening 52 of the second end 48 by another passage 56. The passages 54 and 56 are preferably generally parallel and separate from each other by intervening wall 55 defining cord-engaging portions or stops of the pendant 12 at the ends 42, 48. A recess 58 is provided between the first and second ends 42, 48 of the vertical arm 22, and to facilitate threading the cord 14 throughout the pendant body 12, the recess 58 preferably extends inwardly through both passages 54, 56 in the vertical arm 22. The recess 58 in the vertical arm 22 is adapted to mate with the recess 40 in the horizontal arm 20 such that a flat side 60 of the horizontal arm 20 seats flush with a flat side 62 of the vertical arm 22. It will be appreciated that the horizontal arm 20 and vertical arm 22 may be integral with each other with the passages molded, machined, or otherwise formed therein.

The cord 14 may be threaded throughout the pendant body 12 either before or after connecting the horizontal arm 20 and vertical arm 22 together. The cord 14 is threaded throughout the pendant body 12 by first inserting a free end 62 of the cord 14 into opening 44 and through a first portion 54a of the passage 54 in the vertical arm 22 until it reaches the recess 58 in the vertical arm. The free end 62 is then fed laterally through a first portion 36a of the passage 36 in the horizontal arm 20 by inserting the free end 62 into an opening 64 of the recess 40 of the horizontal arm 20 until it extends out of the external opening 26 in the first end 24 of the horizontal arm 20. The free end 62 is doubled back into the adjacent external opening 28 of the substantially parallel passage 38 such that a first loop 16*a* is formed extending from the horizontal arm 20 and spanning the two openings 26, 28 at the first end 24 of the horizontal arm 20 across the cord-engaging wall 37.

To form a second loop 16*b* of the cord, the free end 62 is inserted through the length of the horizontal passage 38 until it extends out of the external opening 34 in the second end 30 of the horizontal arm 20. The free end 62 is doubled back into the adjacent external opening 32 of the substantially parallel passage 36 and is fed laterally through a portion 36*b* of the passage 36 until the free end 62 is in the area of the recess 40 of the horizontal arm 20 such that the second loop 16*b* is formed extending from the horizontal arm 20 and spanning the two openings 34, 32 at the second end 30 of the horizontal arm 20 across the cord-engaging wall 37.

To form a third loop 16*c* of the cord, the free end 62 is then inserted into an opening 66 in the recess 58 of the vertical arm 22 until the free end 62 extends out of the external opening 50 in the second end 48 of the vertical arm 22. The free end 62 is doubled back into the adjacent external opening 52 in the second end 48 of the vertical arm 22 such that the third loop 16*c* is formed extending from the vertical arm 22 and spanning the two openings 50, 52 at the second end 48 of the vertical arm 22 across the cord-engaging wall 55.

To form a fourth loop 16*d* of the cord, the free end 62 is passed through the length of the passage 56 in the vertical arm 22 until it extends out of the external opening 46 in the first end 42 of the vertical arm 22. The free end 62 and the other end 68 of the cord 14 may then joined together by a clasp 70 to form a continuous cord 14, and in turn, the fourth loop 16*d* which extends from the vertical arm 22 and spans the two openings 44, 46 at the first end 42 of the vertical arm 22 across cord-engaging wall 55. So routed in the pendant, the cord 14 forms four loops 16*a–d* accessible from the exterior of the pendant body 12 which may be adjusted to be worn as a necklace around the neck of a user, or adjusted in size to permit the necklace to be releasably mounted on the display stand 18.

Figure 3:
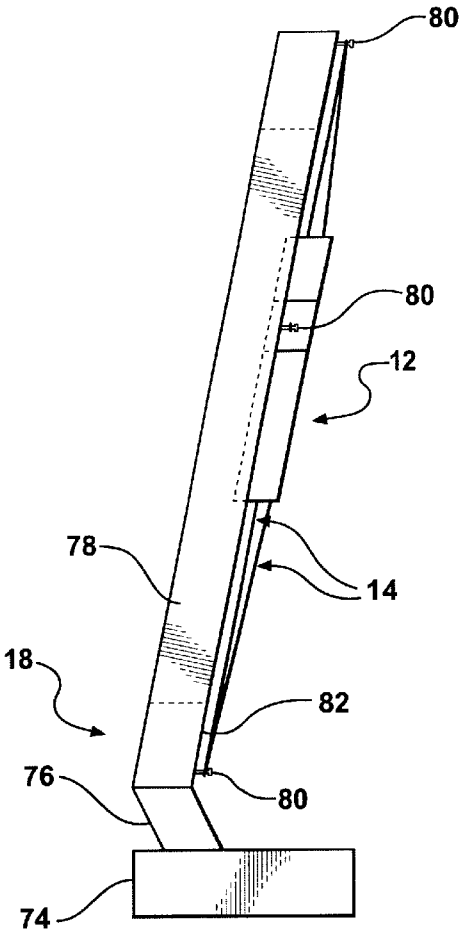
FIG. 3 is a side view showing the necklace assembly releasably attached to the display stand.

As best shown in FIGS. 2 and 3, the display stand or support structure 18 has a substantially flat-bottomed base 74 with a vertical support 76 extending upwardly from the base 74 and fixed thereto. The vertical support 76 is fixed to a frame 78, which may be rectangular in shape as shown having an inner perimeter 79 framing a display opening 81 of the frame 78. The frame 78 preferably has at least one mounting support such as a peg or hook 80 for each loop 16*a–d* extending from the pendant body 12, fixed at spaced apart locations around the perimeter and preferably on the back side 82 of the frame 78. Each hook 80 is adapted to releasably receive a separate loop to releasably mount the pendant to the display stand 18. As best shown in FIG. 2, the hooks 80 are arranged around the perimeter of the frame 78 so that when the loops 16*a–d* are releasably attached thereto, the cord 14 is strung in a decorative manner and a decorative display of the cord 14, pendant body 12 and display stand 18 is created. To demonstrate the flexibility in creation of various design configurations, hooks 80 may be disposed in other locations on the display stand 18 to provide a different pattern of the cord 14 when the necklace assembly 10 is hung on the display stand 18. Many other design configurations, frame shapes and pendant shapes may be used.

The necklace assembly 10 can be worn as a necklace by adjusting one of the loops 16*a–d* to be disposed around the person's neck, preferably the fourth loop 16*d* here, to the maximum size by pulling the loop 16*d* outwardly from the pendant body 12. Because the cord 14 has a generally fixed length, the other loops 16*a–c* will be pulled substantially into the pendant body along the passages and minimized in size so that they do not hang from the pendant body 12. The minimized loops 16*a–c* engage the portions or stops 37, 55 of the pendant body 12 with the pendant body 12 acting as a stop between the openings 26, 28; 32, 34; and 50, 52, of the loops 16*a;* 16*b;* and 16*c,* respectively, from which they extend and remain accessible from the exterior of the pendant body 12 so that they may be manually adjusted as desired.

After wearing the necklace assembly 10, the necklace assembly 10 can be releasably attached to the display stand 18 by drawing the loops 16*a–d* outwardly of the pendant 12 to their proper size of approximately equal length for attachment to the hooks 80 on the frame 78. Preferably, the cord 14 is of a length such that when the loops 16*a–d* are simply disposed over the hooks 80, the cord 14 is taut, thereby retaining the necklace assembly 10 on the display stand 18 and creating a decorative display of the necklace assembly 10 on the display stand 18.

The necklace assembly 10 and display stand 18 may be shared by friends or family. When the two persons are together, the necklace assembly 10 can remain displayed in the display stand 18 to indicate a first condition, such as to symbolize that the two persons are home together. To indicate a second condition, such as when one person is away from home, the necklace assembly 10 can be removed from the display stand 18 and optionally worn as a necklace by the person away from home. The person with the necklace assembly 10 is reminded of the person remaining home, and the person remaining home is reminded of the person that is away by the empty frame 78 of the display stand 18.

Figure 7:
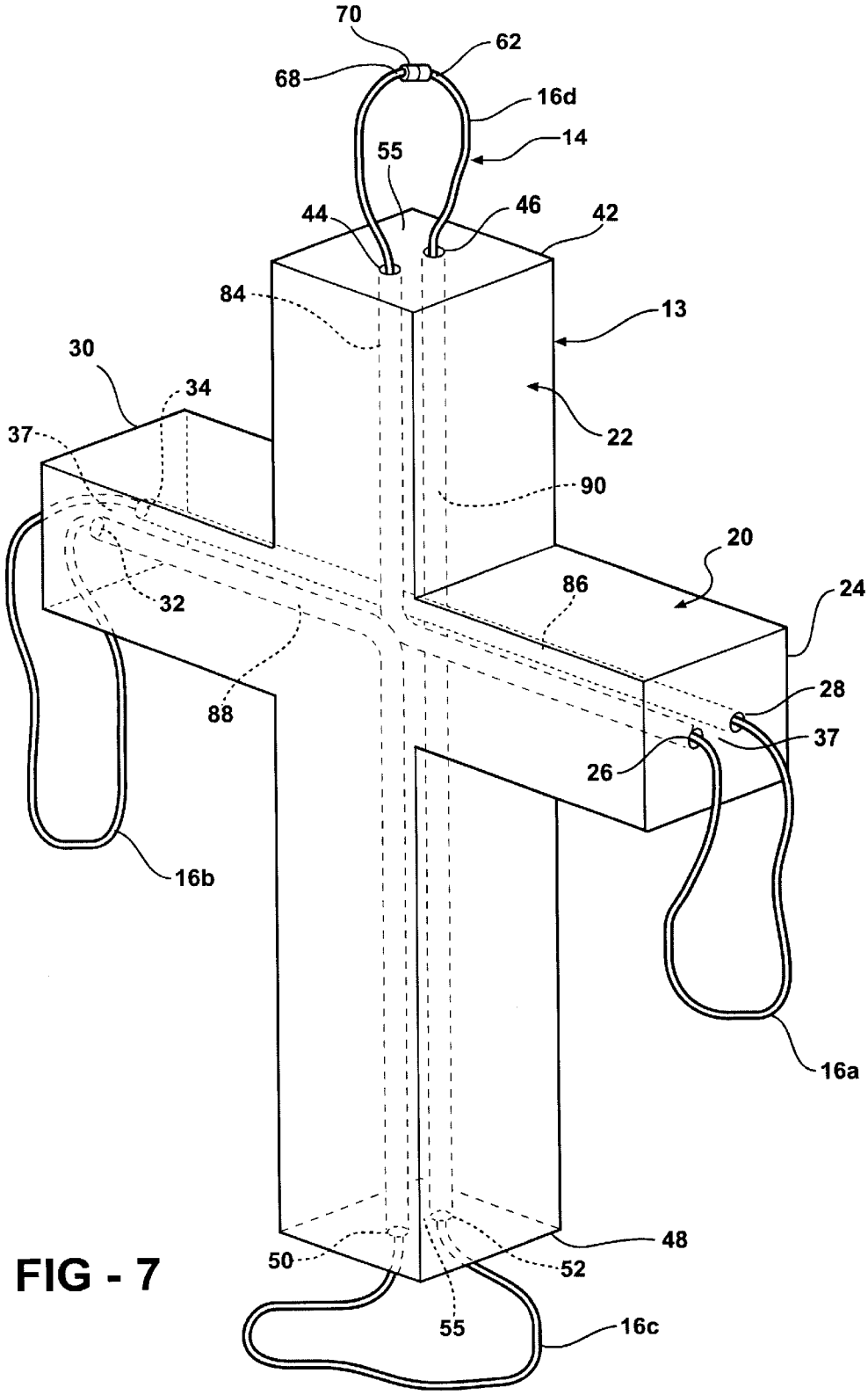
FIG. 7 is a perspective front view of a second embodiment of a pendant according to the invention.

It will be appreciated by those skilled in the art that modifications and variations of this invention may be made without departing from the spirit and scope of the invention. For example, as shown in FIG. 7, a second embodiment of the pendant has a pendant body 13 with non-intersecting passages 84, 86, 88 and 90. The passages 84 and 88 have generally right angle bends such that the passages 84 and 88 are defined in both the vertical arm 22 and the horizontal arm 20. The passage 86 runs through the length of the horizontal arm 20, preferably not intersecting any other passages while the passage 90 runs through the length of the vertical arm 22, preferably not intersecting any other passages. The horizontal arm 20 and vertical arm 22 may be integral with the passages molded or machined therein.

The cord 14 is routed through the pendant body 13 by inserting the free end 62 of the cord 14 through opening 44 and passage 84 until the free end 62 extends out of the opening 26 of the horizontal arm 20. Thereafter, the free end 62 of the cord 14 is routed through the remainder of the pendant body as follows: into opening 28, through passage 86, into opening 32, through passage 88, into opening 52, through passage 90 and out opening 46 so that the free end 62 can be connected to the other end 68 by clasp 70 to provide four adjustable loops 16*a–d* maintained by cord-engaging portions 37, 55 as with the first embodiment. The second embodiment functions in substantially the same manner as the first embodiment and may be worn and displayed in the same manner.

Figure 8:
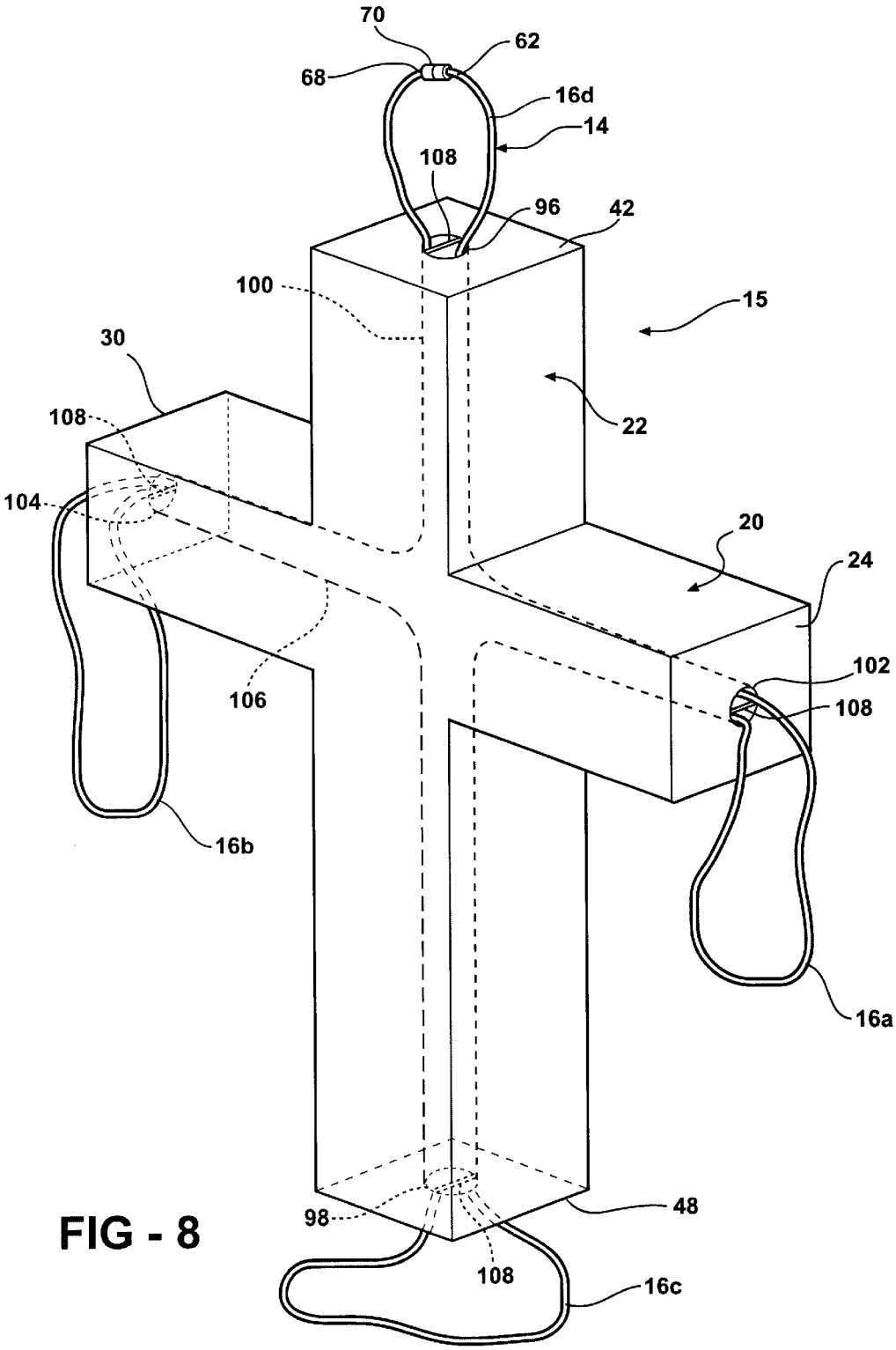
FIG. 8 is a perspective front view of a third embodiment of a pendant according to the invention.

A third embodiment of a pendant, as shown in FIG. 8, has a hollowed pendant body 15, either molded integrally or formed by assembling two pieces together, with openings 96, 98 in the first and second ends 42, 48, respectively, of the vertical arm 22. The openings 96 and 98 are connected by a single passage 100. The horizontal arm 20 has openings 102, 104 in the first and second ends 24, 30, respectively. The openings 102 and 104 are connected by a single passage 106 and the passages 100 and 106 preferably intersect.

The openings 96, 98, 102 and 104 preferably each have a cord-engaging support portion or stop 108 extending across them and carried by the hollowed pendant body 15 to prevent the loops 16*a–d* from being pulled into the passages 100, 106 and to maintain the loops 16*a–d* of the continuous cord 14 accessible from the exterior of the hollowed pendant body 15 so that they may be manually adjusted for use as a necklace assembly 10, or to hang the hollowed pendant body 15 from the display stand 18.

The cord 14 may be routed through the hollowed pendant body 15 by inserting its free end 62 into opening 96 on one side of its stop 108 and part way through passage 100 to passage 106 and out of opening 102 on one side of its stop 108. The free end 62 is then doubled back into opening 102 on the other side of its stop 108 to form loop 16*a*.

To form a second loop 16*c*, the free end 62 is inserted part way through passage 106 to passage 100 and out of opening 108 on one side of its stop 108. The free end 62 is then doubled back into opening 108 on the other side of its stop 108 such that the second loop 16*c* is formed.

To form a third loop 16*b*, the free end is inserted part way through passage 100 to passage 106 and out of opening 104 on one side of its stop 108. The free end 62 is then doubled back into opening 104 on the other side of its stop 108 such that the third loop 16*b* is formed.

To form a fourth loop 16*d*, the free end 62 is inserted part way through passage 106 to passage 100 and out of opening 96 on the other side of its stop 108. The free end 62 is then connected to the other end 68 by clasp 70 to provide four adjustable loops 16*a–d*. The third embodiment functions in substantially the same manner as the first embodiment and may be worn and displayed in the same way.

Figure 9:
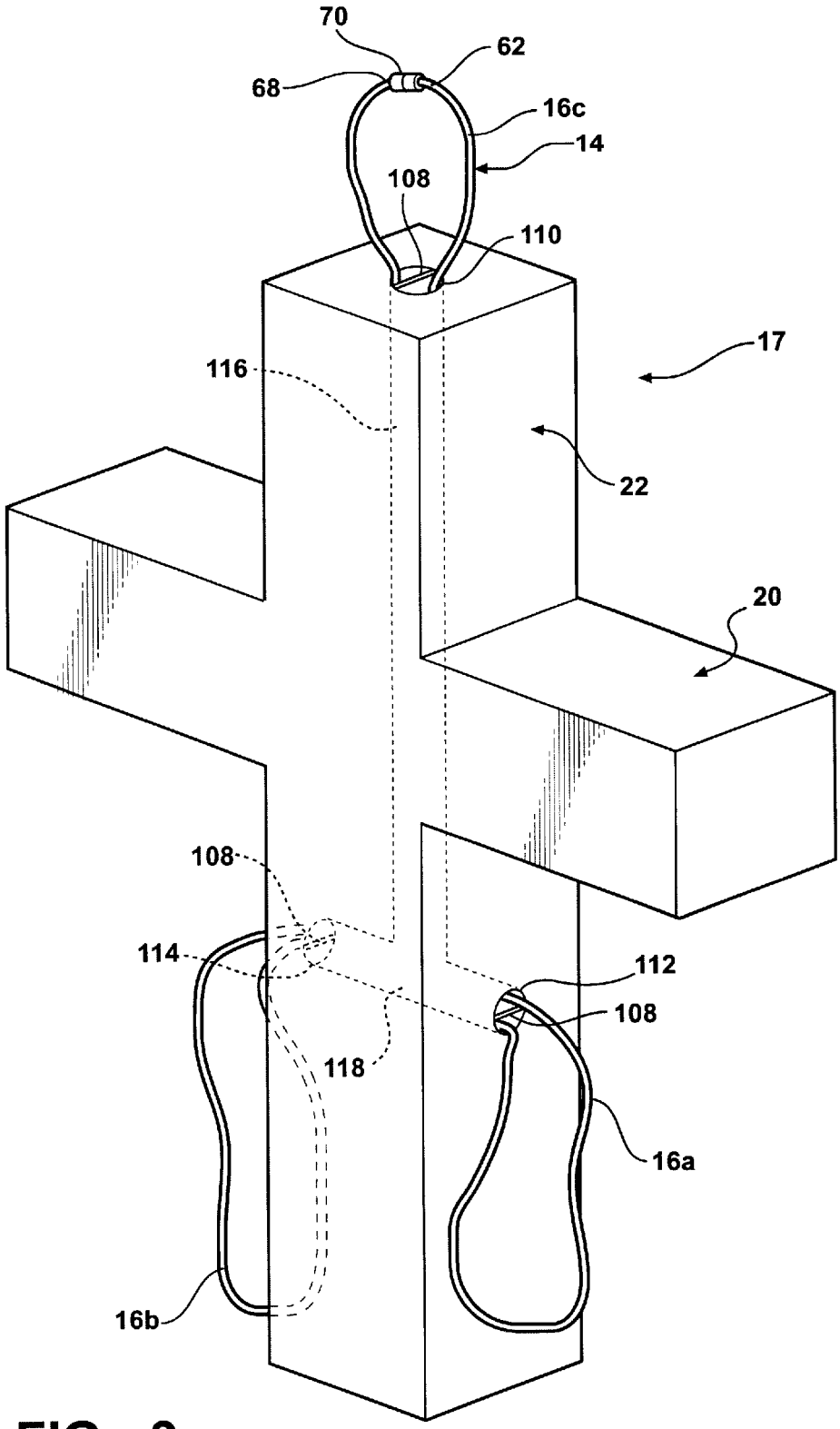
FIG. 9 is a perspective front view of a fourth embodiment of a pendant according to the invention.

A fourth embodiment of a pendant, as shown in FIG. 9, has a pendant body 17 with three openings, 110, 112 and 114 in the vertical arm 22 such that three loops 16*a–c* are formed. The cord 14 may be routed through the pendant body 17 by inserting its free end 62 into opening 110 on one side of its stop 108 and through passage 116 to passage 118 and out of opening 112 on one side of its stop 108. The free end 62 is then doubled back into opening 112 on the other side of its stop 108 to form loop 16*a*.

To form the second loop 16*b*, the free end 62 is inserted through passage 118 and out of opening 114 on one side of its stop 108. The free end 62 is then doubled back into opening 114 on the other side of its stop 108 such that the second loop 16*b* is formed.

To form the third loop 16*c*, the free end 62 is inserted part way through passage 118 to passage 116 and out of opening 110 on the other side of its stop 108. The free end 62 is then connected to the other end 68 by clasp 70 to provide three adjustable loops 16*a–c*. The fourth embodiment pendant functions in the same general manner as the first embodiment and may be worn and displayed in the same general way.

Figure 10:
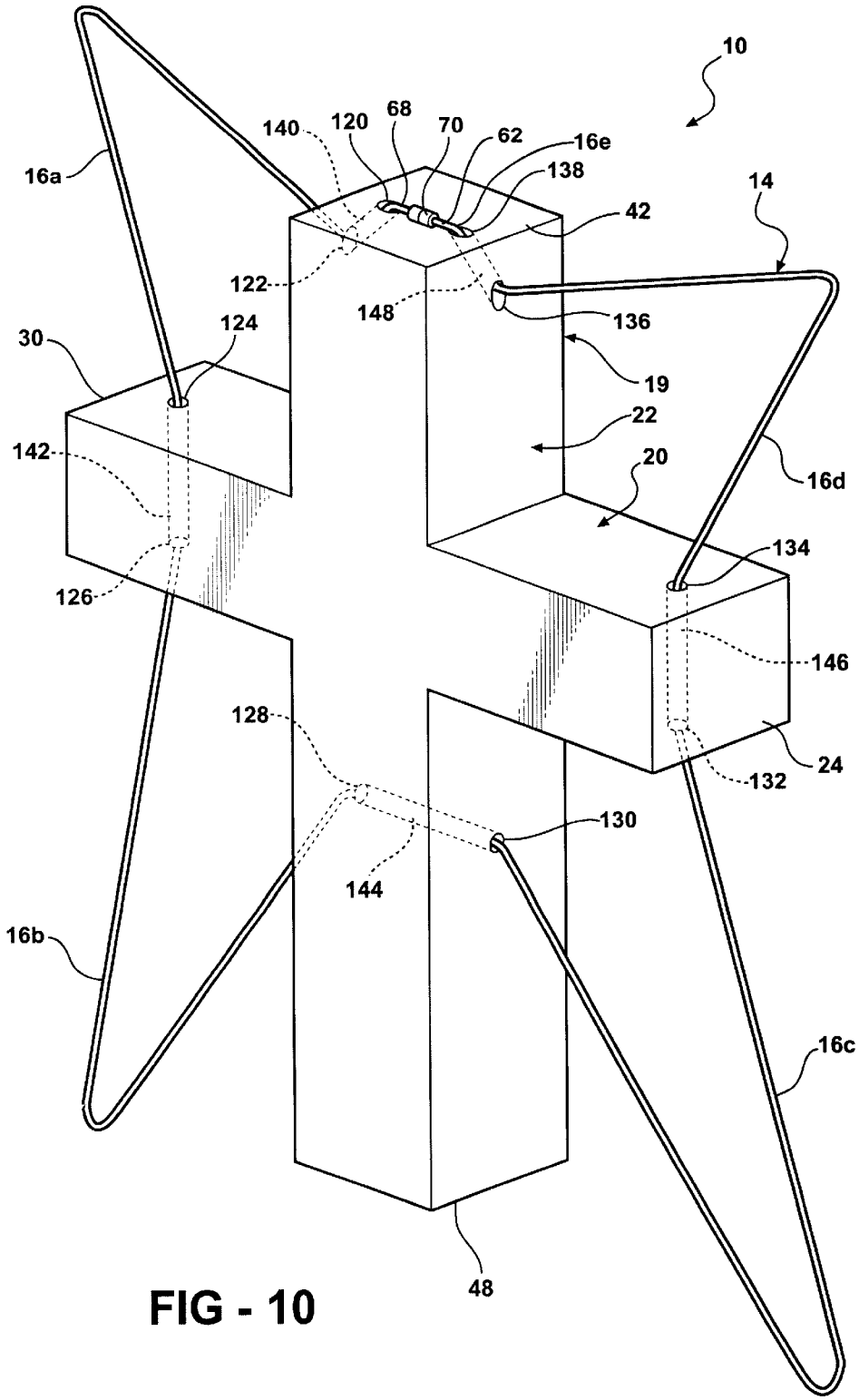
FIG. 10 is a perspective front view of a fifth embodiment of a pendant according to the invention.

A fifth embodiment, as shown in FIG. 10, has a pendant body 19 with openings 120, 138 in the first end 42 of the vertical arm 22 and openings 122, 136 adjacent the first end 42 of the vertical arm 22. The openings 120 and 122 are connected by a single passage 140 and openings 136 and 138 are connected by a single passage 148.

The horizontal arm 20 has opposing openings 124 and 126 adjacent the second end 30 of the horizontal arm 20 with a single passage 142 connecting the openings 124 and 126. The horizontal arm 20 has opposing openings 132 and 134 adjacent the first end 24 of the horizontal arm 20 with a single passage 146 connecting the openings 132 and 134.

The vertical arm 22 has opposing openings 128 and 130 in the lower section of the vertical arm 22 below the horizontal arm 20, with the openings 128 and 130 being connected by a single passage 144.

The cord 14 may be routed through the pendant body 19 by inserting its free end 62 into the opening 120, through passage 140 and out opening 122. The first loop 16*a* is formed by inserting the free end 62 into the opening 124, through passage 142 and out of opening 126. The second loop 16*b* is formed by inserting the free end into the opening 128, through passage 144 and out of opening 130. The third loop 16*c* is formed by inserting the free end into the opening 132, through passage 146 and out of opening 134. The fourth loop 16*d* is formed by inserting the free end into the opening 136, through passage 148 and out of opening 138. Lastly, a fifth loop 16*e* is formed by connecting the free end 62 to the other end 68 by clasp 70. The pendant material between adjacent openings serves as the cord-engaging portion to maintain the multiloop configuration of the cord 14. The fifth loop 16*e* is preferably used for draping the cord around a user's neck to wear the pendant body 19 as a necklace assembly 10 and may be minimized in size, as shown in FIG. 10, when the other loops 16*a*–16*d* are adjusted to hang the pendant body 19 on the display stand 18. The fifth embodiment functions in substantially the same manner as the first embodiment and may be worn and displayed in similar manor.

Figure 11:
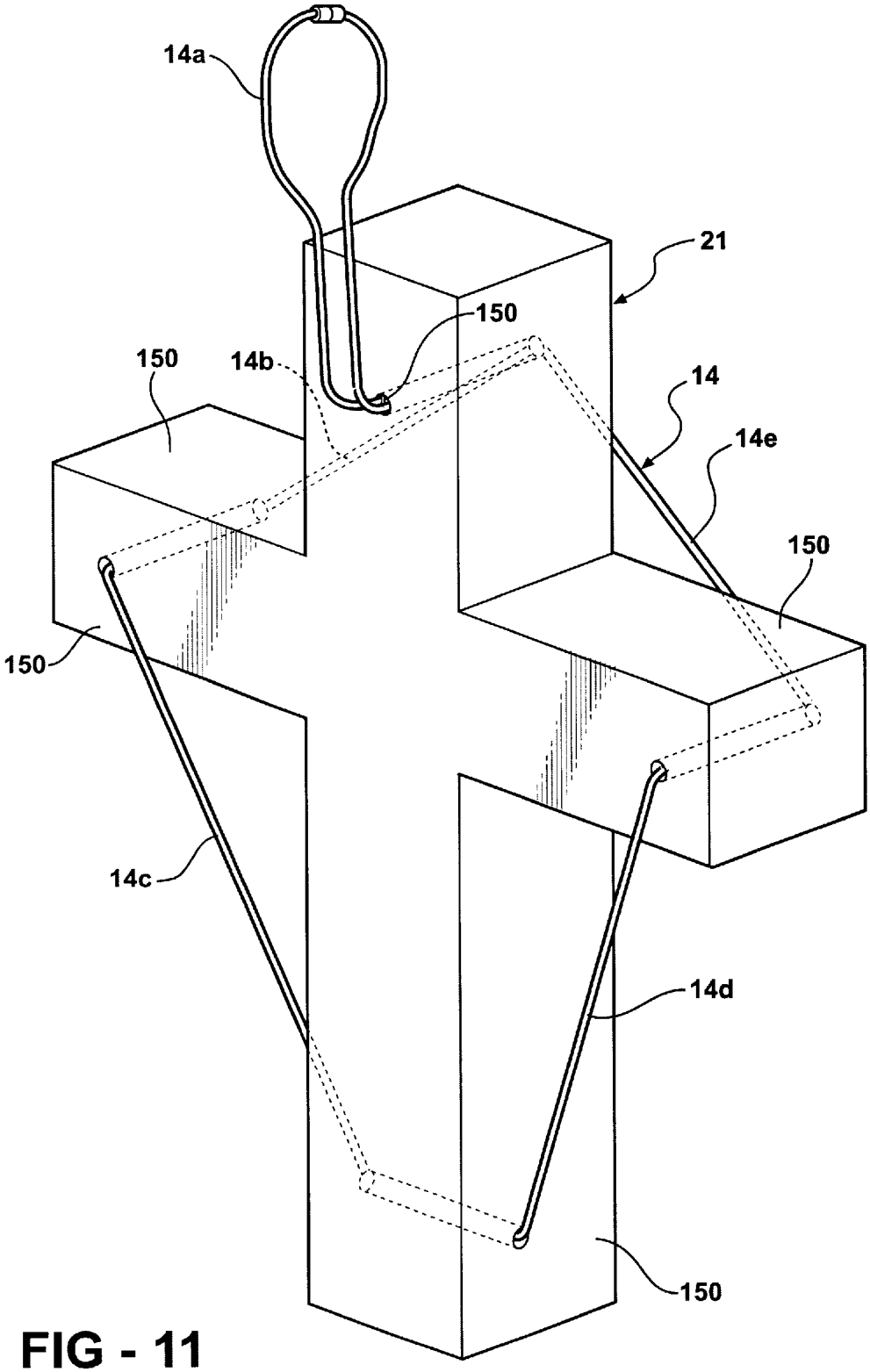
FIG. 11 is a perspective rear view of a sixth embodiment of a pendant according to the invention.

A sixth embodiment, as shown in FIG. 11, has a pendant body 21 with a cord 14 threaded through openings arranged in an alternative way, but achieving the same result of having multiple adjustable loop sections 14*a*, 14*b*, 14*c*, 14*d*, 14*e* of the cord 14 maintained by cord-engaging portions or stops 150 of the pendant 21 as shown. The sixth embodiment pendant functions in substantially the same manner as the first embodiment.

The preferred embodiments of the invention has been described by way of illustration and not limitation. The invention is defined in the claims.

What is claimed is:

1. A necklace assembly comprising:

a pendant body having at least one passage and at least three separate external openings with each opening communicating with at least one other opening through said at least one passage; and a continuous cord slideably received in part in said at least one passage with a portion of said cord extending from and maintained at each of said openings to form at least three loop portions of said cord adjustable in size with said loop portions being accessible from said openings of said pendant body such that when one of said loop portions is adjusted to a maximum size to be disposed around a person's neck the remaining said loop portions are adjusted to a minimum size and can be readily accessed externally of said pendant body and adjusted to lengthen said minimized loop portions when desired.

2. The necklace assembly of claim 1 wherein said pendant body includes at least one stop associated with each loop portion to prevent said loop portions from being pulled beyond said stops.

3. The necklace assembly of claim 1 wherein each of said loop portions is formed by a section of said cord extending out of an opening of the pendant body and is doubled back and received in an opening of the pendant body.

4. The necklace assembly of claim 1 wherein the said at least one passage is machined in said pendant body.

5. The necklace assembly of claim 1 wherein the said at least one passage is molded in said pendant body.

6. The necklace assembly of claim 1 wherein said pendant body has at least four of said passages and at least one of said openings into each of said passages and with at least two of said passages intersecting one another to permit said cord to extend from one of said intersecting passages to the other of said intersecting passages, said cord extending through at least a portion of each of said passages.

7. The necklace assembly of claim 1 wherein the pendant body has eight of said openings and four of said passages, with each of said passages interconnecting two of said openings and being substantially parallel with at least one other passage, and said continuous cord being received in each of said passages and having four of said adjustable loop portions of said cord extending from said pendant body with each of said loop portions spanning two of said openings.

8. The necklace assembly of claim 7 wherein said pendant body includes a vertical arm and a horizontal arm each formed with at least two of said passages and a recess intersecting said passages to facilitate threading said cord throughout said passages of said pendant body and for joining said vertical and horizontal arms to form a generally cross-shaped configuration of said pendant body.

9. The necklace assembly of claim 1, including a display stand having at least three mounting supports spaced from one another and adapted to releasably receive an associated one of said loop portions to releasably mount said pendant body on said display stand by said loop portions.

10. A method of releasably attaching a necklace assembly to a display stand, comprising the steps of:

providing a pendant body having at least three openings with at least one passage connecting the openings;

providing a continuous cord within said at least one passage and extending out of each opening to form at least three adjustable loops of cord extending from the pendant body;

providing a display stand having at least three mounting supports adapted to releasably receive the adjustable loops of cord to retain the pendant body on the display stand; and releasably mounting the pendant body on the display stand by releasably attaching the adjustable loops to the corresponding mounting supports on the display stand.

11. The method of claim 10 including representing a first condition by mounting the necklace assembly on the display stand and representing a second condition by removing the necklace assembly from the display stand.

12. A necklace assembly comprising:

a flexible necklace cord;

a pendant carried on said cord, said pendant having at least three cord-engaging portions spaced from one another and engaging said cord so as to define at least three corresponding loop portions of said cord between said engaging portions which are external to said pendant, said cord being slideable through said engaging portions to permit adjustment in the effective relative lengths of said loop portions, whereby one of said loop portions may be drawn out to maximize its length and minimize the lengths of the remaining loop portions to enable the user to arrange said one of said loop portions about his neck with the pendant being carried at a lower end of the cord, and whereby in another configuration said loop portions may be drawn out to approximate equal lengths to enable said loop portions to be hooked about spaced supports of a frame so as to suspend said pendant in the frame in a decorative manner when not being worn; and a plurality of internal passages opening externally of said pendant and slideably accommodating said necklace cord.

13. The assembly of claim 12 wherein at least some of said passages intersect one another.

14. A method of fabricating and displaying a necklace assembly, comprising:

providing a flexible necklace cord, preparing a pendant having at least three cord-engaging portions spaced from one another;

disposing said pendant on said cord such that said cord-engaging portions slideably engage said cord at spaced locations along the length of the cord in order to define at least three corresponding loop portions of the cord between the cord-engaging portions which are accessible externally of the pendant;

in a first wearing position, manipulating the cord by grasping one of the loop portions and drawing said loop portion outwardly of the pendant to maximize the effective length of said loop portion while simultaneously minimizing the effective length of the other loop portions so as to enable the loop portion that is maximized in length to be placed about the neck of a user such that the pendant hangs from a lower end of the cord;

in a second display position, manipulating the cord by grasping and drawing all of the loop portions outwardly of the pendant to approximately equalize the lengths of the loop portions so as to enable the necklace assembly to be mounted and displayed on a support structure by the loop portions; and providing a display structure having at least three spaced mounting supports, and with the cord arranged in the second display position, disposing each of the loop portions on an associated mounting support in such manner as to suspend the pendant by the cord between the mounting supports.

15. The method of claim 14 including providing a frame as the display structure.

16. The method of claim 15 including preparing the pendant in the shape of a cross having two upright legs and two transverse legs.

17. The method of claim 16 including forming internal passages in the cross-shaped pendant in such manner as to provide an associated cord-engaging portion at each leg of the pendant.

18. The method of claim 17 including forming the passages in such way that at least some of the passages intersect one another internally of the pendant.

19. The method of claim 14 including providing the pendant with four cord-engaging portions to define four associated loop portions of said cord, and providing the display structure with at least four of the mounting supports.

* * * * *